US007314080B2

(12) United States Patent
Giacomino

(10) Patent No.: US 7,314,080 B2
(45) Date of Patent: Jan. 1, 2008

(54) SLIDABLE SLEEVE PLUNGER

(75) Inventor: Jeffrey L. Giacomino, Brighton, CO (US)

(73) Assignee: Production Control Services, Inc., Frederick, CO (US)

( * ) Notice: Subject to any disclaimer, the term of this patent is extended or adjusted under 35 U.S.C. 154(b) by 0 days.

(21) Appl. No.: 11/322,577

(22) Filed: Dec. 30, 2005

(65) Prior Publication Data

US 2007/0151738 A1 Jul. 5, 2007

(51) Int. Cl.
*E21B 43/00* (2006.01)
*F04B 47/12* (2006.01)

(52) U.S. Cl. ..... 166/105; 417/56

(58) Field of Classification Search ..... 166/369, 166/105, 153, 372; 417/56, 57
See application file for complete search history.

(56) References Cited

U.S. PATENT DOCUMENTS

| | | | | |
|---|---|---|---|---|
| 1,993,266 A | | 3/1935 | Evans | |
| 2,661,024 A | | 12/1953 | Knox | 251/65 |
| 2,714,855 A | | 8/1955 | Brown | 103/52 |
| 2,970,547 A | | 2/1961 | McMurry | |
| 3,055,306 A | | 9/1962 | Tausch | |
| 3,181,470 A | * | 5/1965 | Clingman | 417/56 |
| 4,239,458 A | | 12/1980 | Yeatts | |
| 4,502,843 A | | 3/1985 | Martin | |
| 4,712,981 A | | 12/1987 | Gramling | 417/56 |
| 5,253,713 A | | 10/1993 | Gregg et al. | 166/372 |
| 5,333,684 A | | 8/1994 | Walter et al. | 166/54 |
| 5,868,554 A | | 2/1999 | Giacomino et al. | 417/56 |
| 5,941,311 A | | 8/1999 | Newton | 166/369 |
| 6,148,923 A | | 11/2000 | Casey | 166/372 |
| 6,176,309 B1 | | 1/2001 | Bender | 166/68 |

(Continued)

FOREIGN PATENT DOCUMENTS

CA 2 428 618 A1 5/2003

(Continued)

OTHER PUBLICATIONS

Bruce M. Victor, U.S. Appl. No. 10/803,373, "Multi-Part Plunger" filed Mar. 18, 2004. (No copy attached per MPEP 609.04 (a)(II)(C) because Application is stored in Image File Wrapper System.).

(Continued)

*Primary Examiner*—David Bagnell
*Assistant Examiner*—Robert Fuller
(74) *Attorney, Agent, or Firm*—Aileen Law; A Law Firm, P.C.

(57) ABSTRACT

An improved plunger lift mechanism comprises an internal hollow body having bypass orifices that, when exposed, allow fluid to pass through during plunger descent in a downhole tube to the bottom of a production well. A slidable sleeve slides along the hollow body to close the orifices, causing the plunger to rise and carry accumulated fluid to the well surface. In addition, the present apparatus comprises surface interfaces between a slidable sleeve and a mandrel to minimize a probability of mandrel and sleeve separation during the plunger's ascent phase and a risk of plunger stall.

By integrating a plunger lift having a slidable sleeve with closer limits between the slidable sleeve and an internal hollow body, and a wider plunger surface area, the present apparatus can minimize radial movement which can occur during plunger drop and when impact occurs.

20 Claims, 6 Drawing Sheets

U.S. PATENT DOCUMENTS

| | | | | |
|---|---|---|---|---|
| 6,209,637 | B1 | 4/2001 | Wells | 166/153 |
| 6,241,014 | B1 | 6/2001 | Majek et al. | 166/53 |
| 6,273,690 | B1 | 8/2001 | Fischer, Jr. et al. | 417/555.2 |
| 6,554,580 | B1 * | 4/2003 | Mayfield et al. | 417/56 |
| 6,591,737 | B2 | 7/2003 | Giacomino | 92/193 |
| 6,637,510 | B2 | 10/2003 | Lee | 166/108 |
| 6,644,399 | B2 | 11/2003 | Abbott et al. | |
| 6,669,449 | B2 | 12/2003 | Giacomino | 417/56 |
| 6,705,404 | B2 | 3/2004 | Bosley | 166/372 |
| 6,719,060 | B1 | 4/2004 | Wells | |
| 6,725,916 | B2 | 4/2004 | Gray et al. | 166/68.5 |
| 6,746,213 | B2 | 6/2004 | Giacomino | 417/56 |
| 6,907,926 | B2 | 6/2005 | Bosley | 166/108 |
| 6,935,427 | B1 | 8/2005 | Billingsley | 166/301 |
| 6,945,762 | B2 | 9/2005 | Williams | 417/546 |
| 7,121,335 | B2 | 10/2006 | Townsend | |
| 2003/0141051 | A1 | 7/2003 | Abbott et al. | 166/53 |
| 2003/0155129 | A1 | 8/2003 | Gray et al. | 166/370 |
| 2003/0215337 | A1 | 11/2003 | Lee | 417/56 |
| 2004/0129428 | A1 | 7/2004 | Kelley | 166/372 |
| 2004/0226713 | A1 * | 11/2004 | Townsend | 166/105 |
| 2005/0178543 | A1 | 8/2005 | Giacomino | |
| 2005/0194149 | A1 | 9/2005 | Giacomino | |
| 2005/0230120 | A1 | 10/2005 | Victor | 166/372 |
| 2005/0241819 | A1 | 11/2005 | Victor | |

FOREIGN PATENT DOCUMENTS

| | | | |
|---|---|---|---|
| CA | 2 497 714 | A1 | 2/2004 |
| RU | 2225502 | | 3/2004 |

OTHER PUBLICATIONS

Jeffrey L. Giacomino, U.S. Appl. No. 11/060,513, "Data Logger Plunger" filed Feb. 17, 2005. (No Copy attached per MPEP 609.04 (a)(II)(C) because Application is stored in Image File Wrapper System.).

Bruce M. Victor, U.S. Appl. No. 11/110,447, "Variable Orifice Bypass Plunger" filed Apr. 20, 2005. (No Copy attached per MPEP 609.04 (a)(II)(C) because Application is stored in Image File Wrapper System.).

Bruce M. Victor, U.S. Appl. No. 11/105,753, "Sand Plunger" filed Apr. 14, 2005. (No Copy attached per MPEP 609.04 (a)(II)(C) because Application is stored in Image File Wrapper System.).

Bruce M. Victor, U.S. Appl. No. 11/010,168, "Internal Shock Absorber Bypass Plunger" filed Dec. 10, 2004. (No Copy attached per MPEP 609.04 (a)(II)(C) because Application is stored in Image File Wrapper System.).

Bruce M. Victor, U.S. Appl. No. 11/124,805, "Liquid Aeration Plunger" filed May 9, 2005. (No Copy attached per MPEP 609.04 (a)(II)(C) because Application is stored in Image File Wrapper System.).

MGM Well Service, Inc., Pacemaker Plunger, Co., P.O. Box 270924, Corpus Christi, TX 78427-0924 Six pages of internet marketing materials describing various Pacemaker Plungers, Feb. 12, 2003.

Jeffrey L. Giacomino, U.S. Appl. No. 11/071,148, "Thermal Activated Plunger" filed Mar. 3, 2005. (No Copy attached per MPEP 609.04 (a)(II)(C) because Application is stored in Image File Wrapper System.).

* cited by examiner

SLIDABLE SLEEVE PLUNGER

FIELD OF ART

The present apparatus relates to a plunger lift for lifting formation fluids in a hydrocarbon well. More specifically, the plunger comprises a flow-through plunger body having a slidable sleeve operating to allow fluid to bypass the body and fall against flow in conjunction with well parameters.

BACKGROUND

A plunger lift is typically an apparatus that can be used to increase the productivity of oil and gas wells. In the early stages of a well's life, liquid loading may not be a problem. When production rates are high, well liquids are typically carried out of the well tubing by high velocity gas. As a well declines and production decreases, a critical velocity may be reached wherein heavier liquids may not make it to the surface. Rather, the heavier liquids may start to fall back to the bottom of the well. This liquid drop can exert back pressure on the formation, which "loads up" the well. As a result, the gas being produced by the formation can no longer carry the liquid being produced to the surface. As gas flow rate and pressures decline in a well, lifting efficiency can decline substantially.

Liquid drop may occur for two reasons. First, as liquid comes in contact with the wall of the production string of tubing, friction slows the velocity of the liquid. Some of the liquid may adhere to the tubing wall, creating a film of liquid on the tubing wall which does not reach the surface. Second, as the liquid velocity continues to slow, the gas phase may no longer be able to support liquid in either a slug form or a droplet form. Along with the liquid film on the sides of the tubing, a slug or droplet(s) may begin to fall back to the bottom of the well. In a very aggravated situation there will be liquid accumulated in the bottom of the well. The produced gas must bubble through the liquid at the bottom of the well and then flow to the surface. However, as gas advances through the accumulated liquid, the gas may proceed at a low velocity. Thus, little liquid, if any, may be carried to the surface by the gas, resulting in only a small amount of gas being produced at the surface. A plunger lift can act to remove the accumulated liquid.

A plunger system is a method of unloading gas in high ratio hydrocarbon wells without interrupting production. A plunger lift system utilizes gas present within the well as a system driver. Generally, wells making no gas are not plunger lift candidates.

A plunger lift system works by cycling a well open and closed. During operation, a plunger typically travels to the bottom of a well where loading fluid may be picked up or lifted by the plunger and brought to the surface, thus removing all liquids in the tubing. The plunger can also keep the tubing free of paraffin, salt or scale build-up. During the open time, a plunger interfaces a liquid slug and gas. The gas below the plunger will push both the plunger and the liquid on top of the plunger to the surface. As liquid is removed from the tubing bore, an otherwise impeded volume of gas can begin to flow from a producing well.

In U.S. Pat. Pub. No. US 2004/0226713 A1 dated Nov. 18, 2004, Townsend describes a plunger with an elongate body having two ends, a sleeve overlying the body and having a first and second end and an interior bore and being shorter in length than the elongate body. The plunger has a circumferential seal on the exterior surface of the sleeve to provide a barrier to the passage of gas or fluids during closure. The elongate body is a solid body and flow passes directly into the sleeve. The flow passes through the sleeve between the elongate body and the sleeve when the bypass function is open during plunger descent to the well bottom. The outer diameter of the elongate body and the inner diameter of the sleeve are not constant throughout, allowing for radial movement between the two pieces at one end.

SUMMARY OF THE DISCLOSURE

The present apparatus provides a slidable sleeve bypass plunger apparatus having bypass orifices that allow fluid to pass through a hollow body or inner rod during plunger descent in a downhole tube to the bottom of a production well. As known by those skilled in the art, fluid and/or flow can relate to gas, liquid, or a mixture of both. The hollow body/rod (or mandrel) of the present apparatus comprises at least one bypass orifice locatable near a bottom end for fluid entry and at least one bypass orifice locatable near a top end for fluid egress. As the slidable sleeve slides along the mandrel, the bypass orifices can either be exposed or closed, which thereby opens and closes the means for fluid flow, respectively. The bypass orifices can be varied in number, shape, location, and/or size to accommodate a desired application.

At the top of a production well, the bypass orifices would generally be exposed; the sleeve is in an open position. The plunger travels down the well allowing fluid to enter the plunger through the at least one entry orifice, flow through the plunger's mandrel, and to exit the plunger through the at least one egress orifice. When the plunger reaches the end of the well, the velocity of the plunger permits the end of the plunger to strike the bottom of the well. The impact of the strike forces the sleeve of the plunger to slide down and close the entry orifice, whereby the sleeve is in a closed position. The plunger, now closed, travels back up the well by the pressure of the accumulated gases. As the plunger reaches the top of the production well, the slidable sleeve slides into an open position when it strikes the top of the well, causing the plunger to once again fall downhole. The present apparatus provides an improved slidable sleeve bypass plunger apparatus for increasing well production levels in a well having high flow parameters. In addition, the present apparatus comprises surface interfaces between a slidable sleeve and a mandrel to minimize a probability of sleeve and mandrel separation during the plunger's ascent phase. The present apparatus also reduces risk of plunger stalling as a result of line pressure during its rise to the well top.

Radial movement between the mandrel and the slidable sleeve typically occurs as the plunger drops and when impact occurs at the well bottom/top. By integrating a plunger lift having a slidable sleeve with tighter limits between the inner diameter of the slidable sleeve and the outer diameter of a mandrel of the plunger body, the present apparatus minimizes radial movement. Thus, with the optimized tolerances, the present apparatus allows the plunger to exert an axial force in a true vertical direction when the plunger strikes the well bottom, which can prolong plunger integrity. Not only may the present apparatus contribute to increased lift efficiency of fluid in a high flow well during lift, lift cycle time and/or well production can be improved as a result of the plunger dropping back to the well bottom quickly and easily. In addition, the present apparatus may also provide a slidable sleeve bypass plunger that could efficiently descend inside the tubing to the well bottom with an increased speed without impeding well production. With the present apparatus, various plunger sidewall geometries can be integrated with a slidable sleeve.

These and other features and advantages of the disclosed apparatus reside in the construction of parts and the combination thereof, the mode of operation and use, as will become more apparent from the following description, reference being made to the accompanying drawings that form a part of this specification wherein like reference characters designate corresponding parts in the several views. The embodiments and features thereof are described and illustrated in conjunction with systems, tools and methods which are meant to exemplify and to illustrate, not being limiting in scope.

Before explaining the disclosed embodiments in detail, it is to be understood that the embodiments are not limited in application to the details of the particular arrangements shown, since other embodiments are possible. Also, the terminology used herein is for the purpose of description and not of limitation.

DETAILED DESCRIPTION OF THE DRAWINGS

Figure 1:
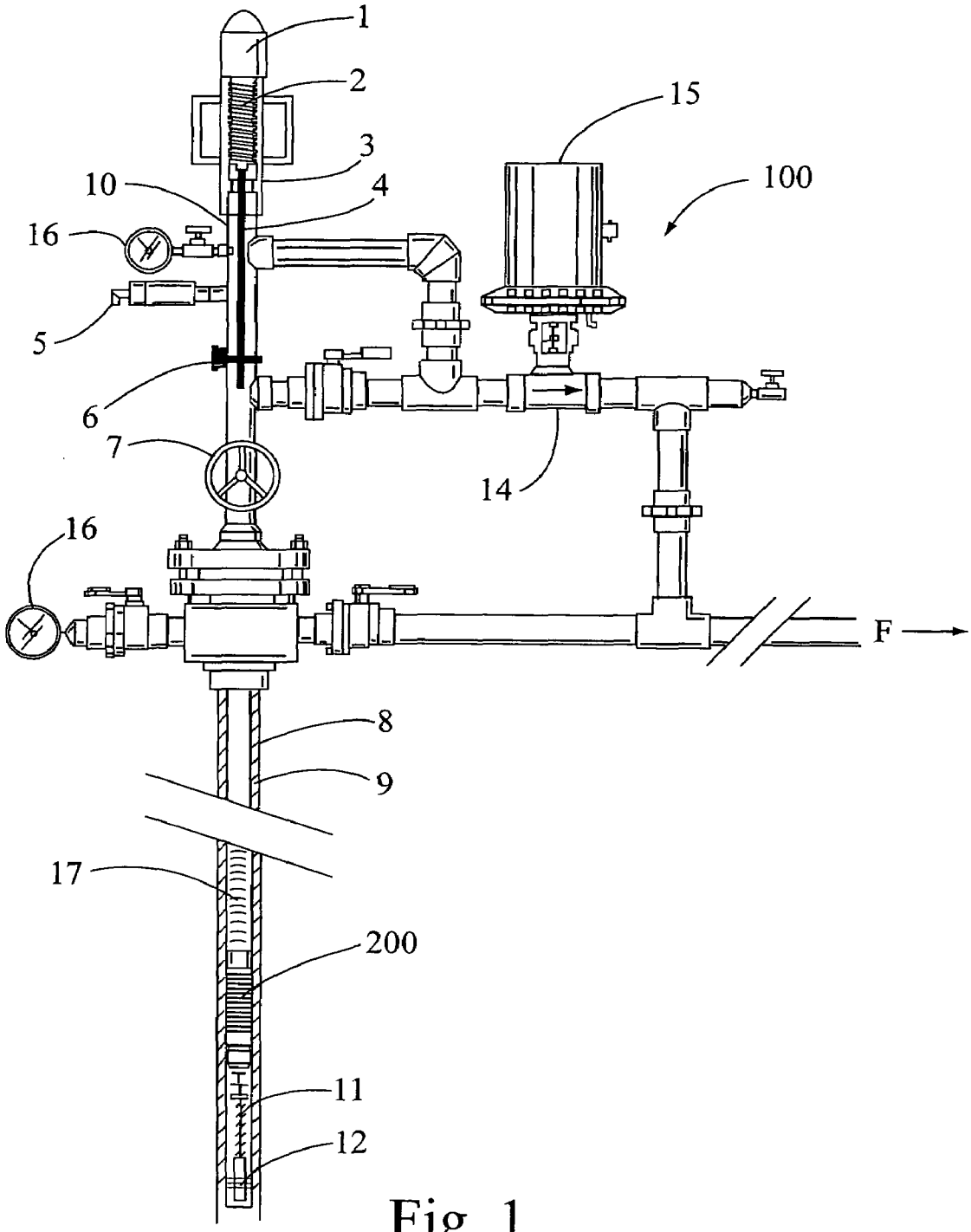
Fig. 1 (PRIOR ART)
FIG. 1 (prior art) is an overview depiction of a typical plunger lift system installation.

FIG. 1 shows a typical installation plunger lift system 100. Plunger 200 can represent the presently disclosed plunger or other plungers which may include the prior art. Fluid 17, which is shown accumulated on top of plunger 200, can be carried to the well top by plunger 200.

Lubricator assembly 10 comprises cap 1, integral top bumper spring 2, striking pad 3, and extracting rod 4. Extracting rod 4 may or may not be employed depending on the plunger type. For example, an extracting rod may not be required for various embodiments of the present apparatus. Lubricator 10 houses plunger auto catching device 5 and plunger sensing device 6. Surface controller 15, which opens and closes the well at the surface, typically receives a signal from sensing device 6 upon plunger 200 arrival at the well top. A plunger's arrival at the well top can be used as an indicator of how to optimize a desired well production, flow times, wellhead operating pressures, etc. Master valve 7 should be sized correctly for the tubing 9 and plunger 200. An incorrectly sized master valve 7 could prevent plunger 200 from passing. For example, master valve 7 could incorporate a full bore opening equal to the tubing 9 size. An oversized valve could also cause gas to bypass the plunger, causing the plunger to stall in the valve. If the plunger is to be used in a well with relatively high formation pressures, care should be taken to balance tubing 9 size with casing 8 size.

The bottom of a well is typically equipped with a seating nipple/tubing stop 12. In FIG. 1, spring standing valve/bottom hole bumper assembly 11 is located near the tubing bottom. The bumper spring is located above the standing valve and can be manufactured as an integral part of the standing valve or as a separate component of a plunger system.

Surface control equipment usually comprises motor valve(s) 14, sensors 6, pressure recorders 16, etc., and electronic surface controller 15. Fluid flow proceeds downstream in direction 'F' when surface controller 15 opens well head flow valves. Depending on the application, controllers can operate on time, or pressure, to open or close the surface valves based on operator-determined requirements for production. Thus, if desired, the present apparatus can employ modern electronic controllers that incorporate user friendly and easy to program interfaces, although mechanical controllers and other electronic controllers could be chosen as well. The present apparatus can also be integrated with controllers that feature battery life extension through solar panel recharging, computer memory program retention in the event of battery failure and built-in lightning protection. For complex operating conditions, controllers having multiple valve capability to fully automate the production process can be utilized.

When motor valve 14 opens the well to the sales line (not shown) or to atmosphere, the volume of gas stored in the casing and the formation during the shut-in time typically pushes both the fluid load and plunger up to the surface. Forces which exert a downward pressure on a plunger can comprise the combined weight of the fluid and the plunger as well as the operating pressure of the sales line together with atmospheric pressure. Forces which exert an upward pressure on a plunger can comprise the pressure exerted by the gas in the casing. Frictional forces can also affect a plunger's movement. For example, once a plunger begins moving to the surface, friction between the tubing and the fluid load opposes plunger movement. Friction between the gas and tubing also slows an expansion of the gas. However, in a plunger installation, generally it is only the pressure and volume of gas in the tubing and/or casing annulus which serves as the motive force for bringing the fluid load and plunger to the surface.

Figures 2A, 2B, 2C, 2D:
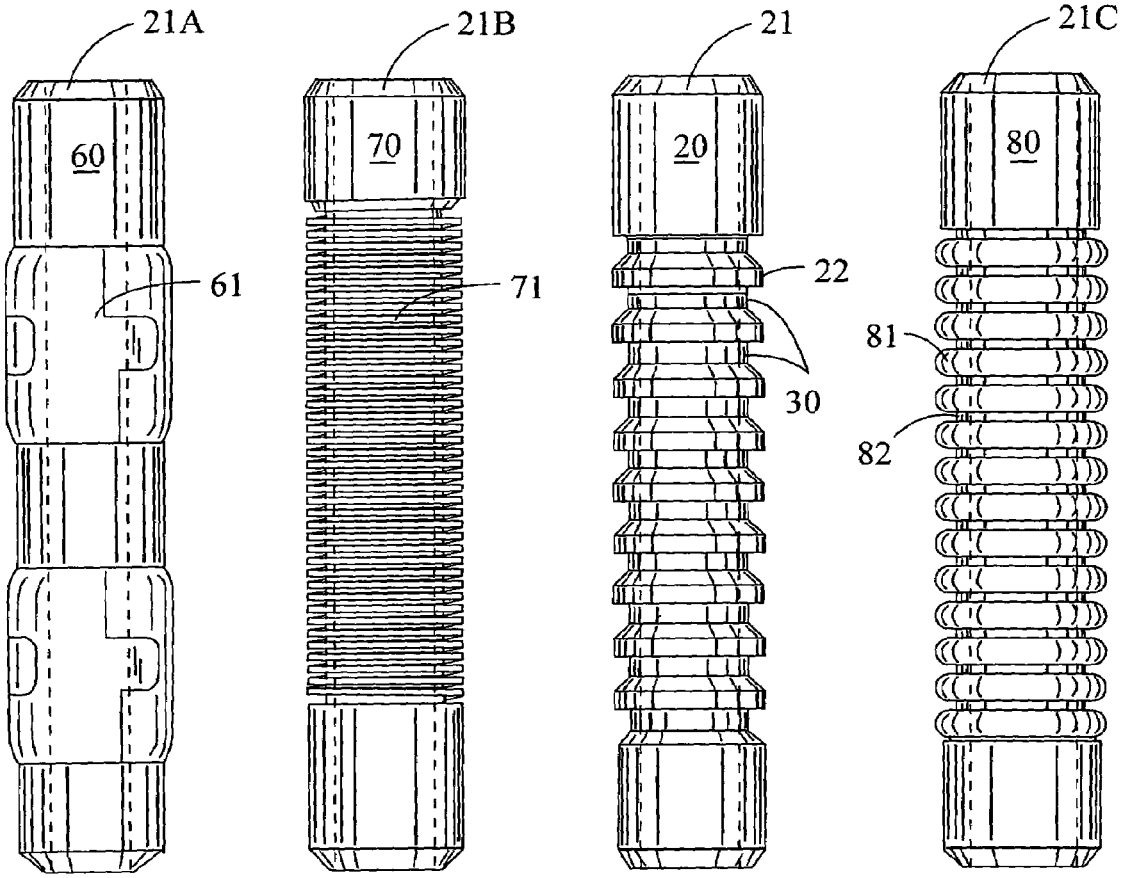
FIGS. 2A, 2B, 2C, 2D illustrate plungers of varying sidewall geometries.

Modern plungers can be designed with various sidewall geometries. Some examples are set forth in FIGS. 2A through 2D. In FIG. 2A, pad plunger 60 has spring-loaded interlocking pads 61 in one or more sections. Interlocking pads 61 expand and contract to compensate for any irregularities in the tubing, thus creating a tight friction seal. In FIG. 2B, brush plunger 70 incorporates a spiral-wound, flexible nylon brush 71 surface to create a seal and allow the plunger to travel despite the presence of sand, coal fines, tubing irregularities, etc. Solid ring 22 sidewall geometry is shown in the solid ring plunger 20 of FIG. 2C. Solid sidewall rings 22 can be made of various materials such as steel, poly materials, Teflon®, stainless steel, etc. Inner cut groves 30 allow sidewall debris to accumulate when a plunger is rising or falling. In FIG. 2D, shifting ring plunger 80 is shown with shifting ring 81 sidewall geometry. The sidewall geometry of shifting rings 81 allow for continuous contact against the tubing to produce an effective seal with wiping action to ensure that all scale, salt or paraffin is removed from the tubing wall. Shifting rings 81 are all individually separated at each upper surface and lower surface by air gap 82. Snake plungers (not shown) are flexible for coiled tubing and directional holes, and can be used as well in straight standard tubing.

As with the disclosed embodiment, some plunger designs may have bypass valves that permit fluid or gas to flow through the plunger. During a plunger's descent toward the bumper spring, fluid flows through the plunger. As stated above, the bypass valve would be in the "open bypass" mode. The open mode can allow for a faster plunger travel rate (or decreased travel time) down the hole in high flow wells. When the plunger reaches the bottom, the bypass valve closes so that fluid/gas flows around the plunger instead of flowing through the plunger. As stated above, the bypass valve is in the "closed bypass" mode. The plunger travels to the well top in the closed mode. The bypass feature can optimize plunger travel time in high fluid wells. Optimum travel time, in turn, results in efficient well production.

Recent practices involve producing slim-hole wells that utilize coiled tubing. Because of their small tubing diameters, slim-hole wells may load up as a result of a relatively small amount of fluid. In addition, a relatively small amount of paraffin could cause plugging of the tubing. Thus, a plunger lift system may be used in slim-hole well applications to cycle an impeded well open.

A plunger generally falls at a slower rate through liquid than through gas. Therefore, in certain high fluid wells, a fluid build-up may hamper the plunger's descent toward the bumper spring at the well bottom and further delay cycle time of the plunger system. Specifically, plunger delay on the return trip to the well bottom tends to occur in wells with a high fluid level. To optimize production, a plunger could be used to displace the fluid buildup.

In FIGS. 2A, 2B, 2C, 2D, plungers 60, 70, 20, 80 comprise respective internal flow through orifices 21A, 21B, 21, 21C which can accept mandrel 40 as shown in the remaining figures.

Figure 3:
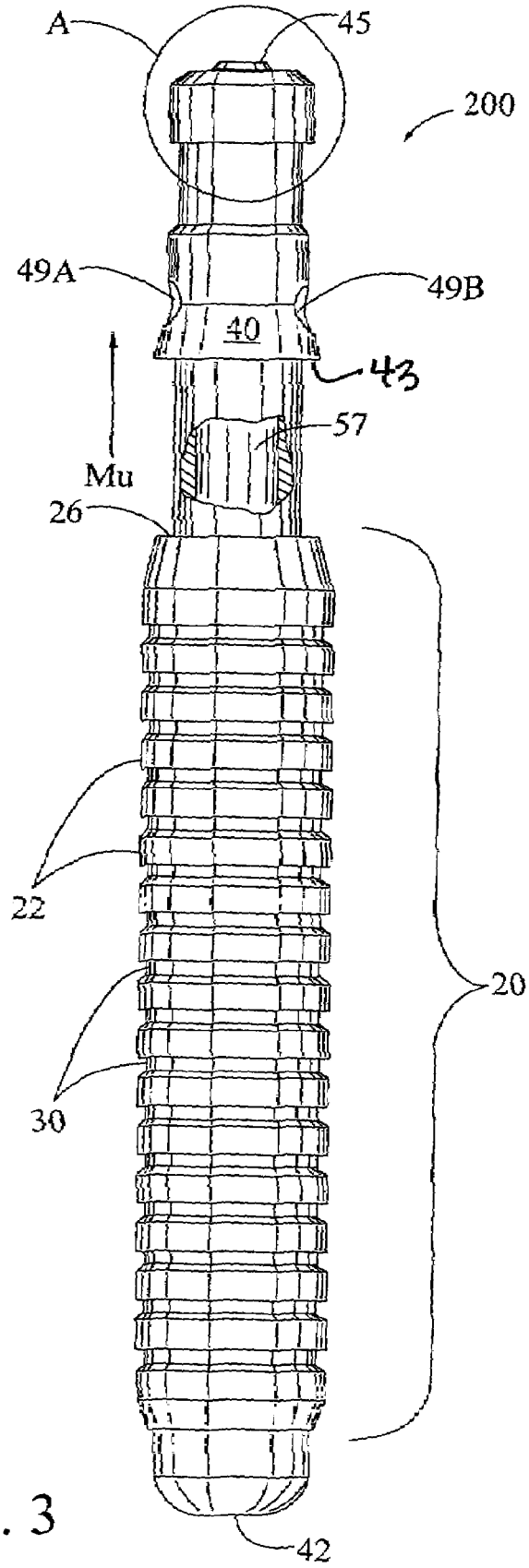
FIG. 3 is a side plan view of one embodiment of a slidable sleeve plunger.

FIG. 3 is a plan view of a slidable sleeve plunger embodiment 200 which incorporates solid sidewall geometry as described in FIG. 2C. Plunger mandrel 40 comprises a top end, a bottom end 42, and a mandrel orifice 57 through which fluid passes during plunger descent to the well bottom. Mandrel 40 is movable in an axial direction internally within slidable sleeve 20. Here, plunger 200 is shown in the "closed bypass" position, which signifies that the means for fluid flow are closed and fluid may not enter plunger 200. As depicted, plunger 200 may ascend and carry any loading fluid to the surface, removing fluids residing above plunger 200 from the well tubing. When top end A of mandrel 40 strikes the top of the well, the impact of the strike will force sleeve 20 into an "open bypass" position. A top flange surface 26 of slidable sleeve 20 would contact an upper flange surface 43 of mandrel 40, thereby exposing the plunger bypass orifices 48 (not shown) such that fluid enters and flows through plunger 200. Although not shown, in an "open bypass" position, plunger 200 would then descend toward the well bottom. When bottom end 42 strikes the well bottom, the impact will then force mandrel 40 to move in an upward direction $M_U$ causing the bypass function to be in a "closed bypass" position as shown in FIG. 3. Although top end A of mandrel 40 features a standard American Petroleum Institute (API) fishing neck design, other neck designs may be employed. Mandrel 40 also comprises removable top plug 45 which can seal mandrel orifice 57 at top end A.

Figure 4A:
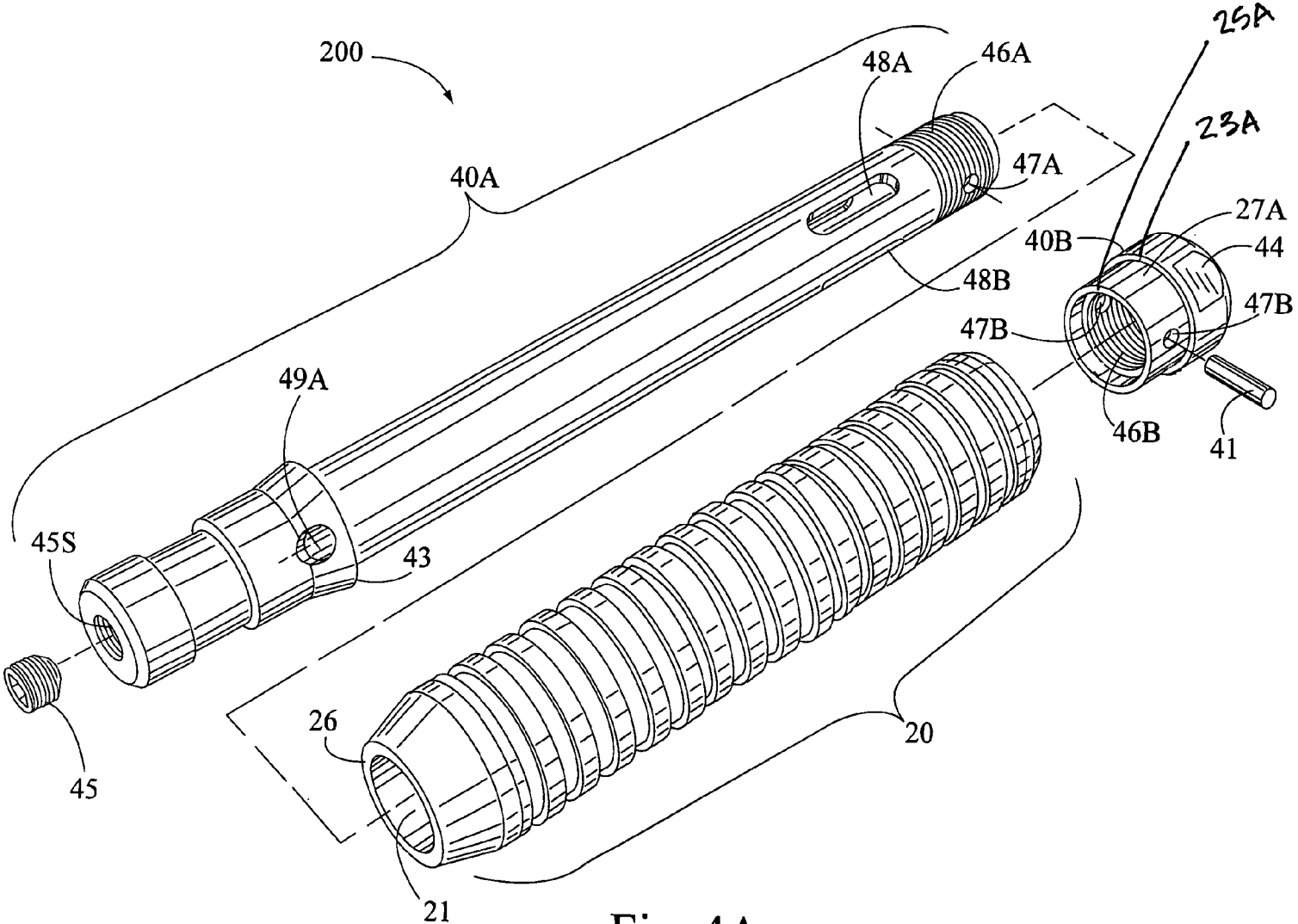
FIG. 4A is a top perspective exploded view of the slidable sleeve plunger of FIG. 3.
Figure 4B:
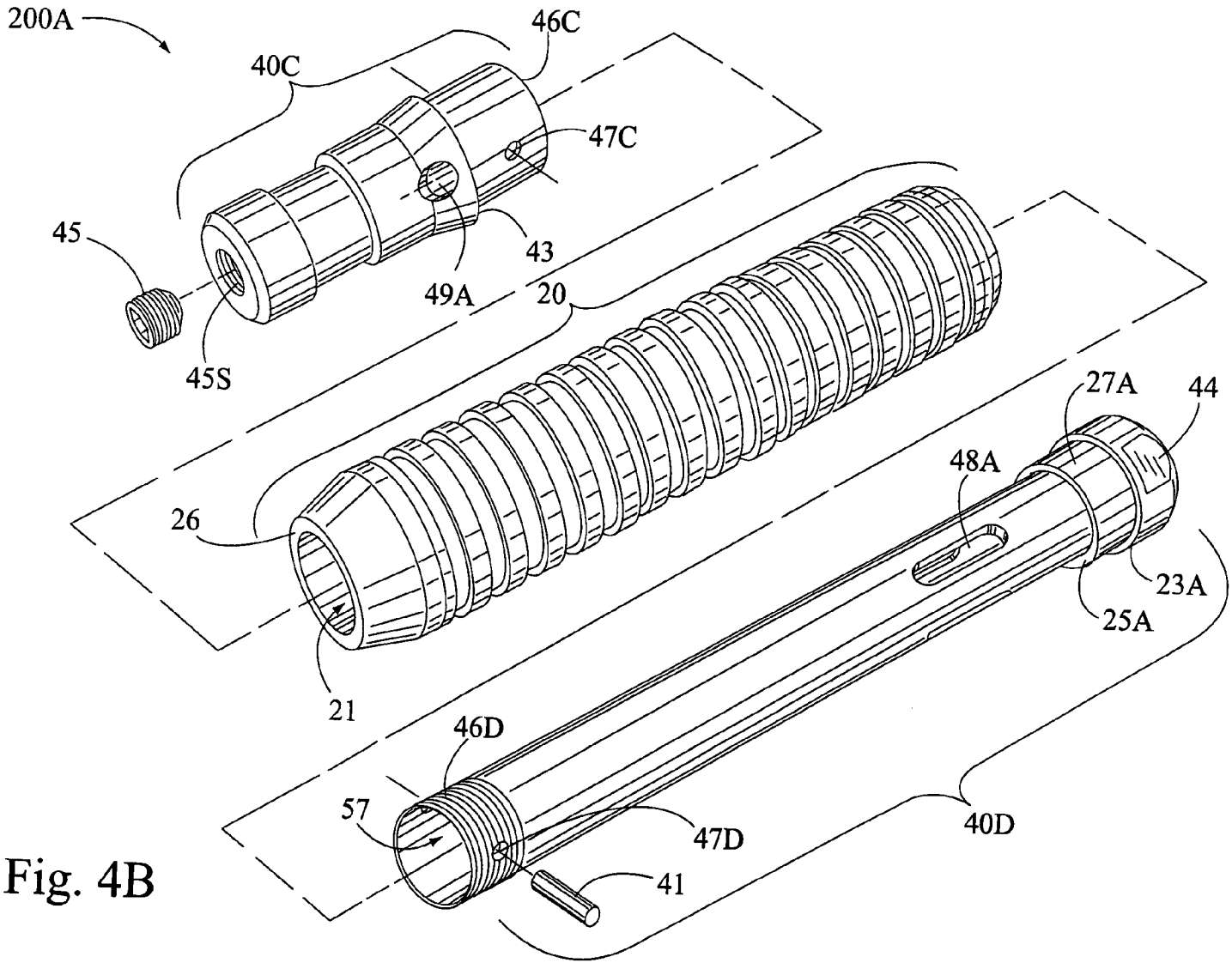
FIG. 4B is a top perspective exploded view of an alternate embodiment of a slidable sleeve plunger.

In the disclosed embodiment of FIG. 3, mandrel 40 further comprises three fluid entry openings 48 located at about 120° intervals from one another about its lower circumference (not shown but see FIGS. 4A, 4B). Mandrel 40 further comprises three fluid exit openings 49 located at about 120° from one another about its upper circumference. In the plan view of FIG. 3, exit orifices 49A, 49B are visible.

Figure 5:
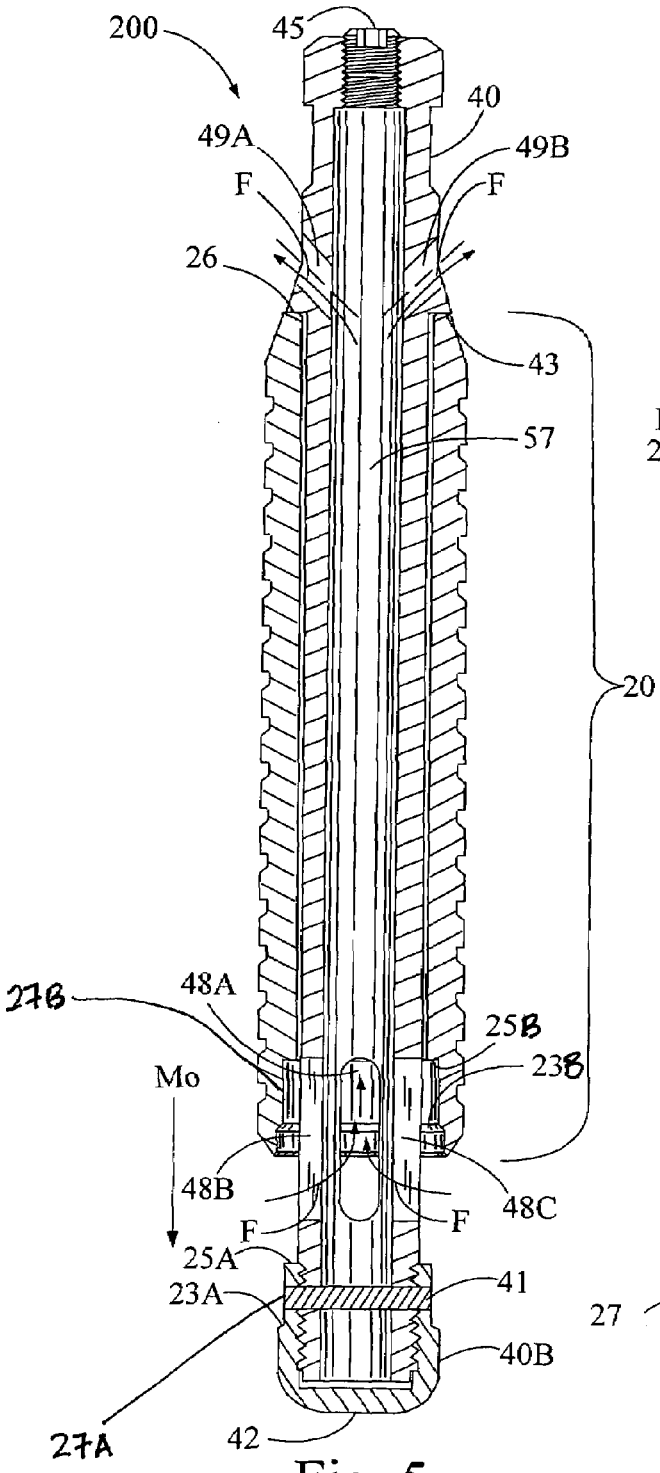
FIG. 5 is a cross-sectional view of a slidable sleeve plunger in an "open bypass" position.
Figure 6:
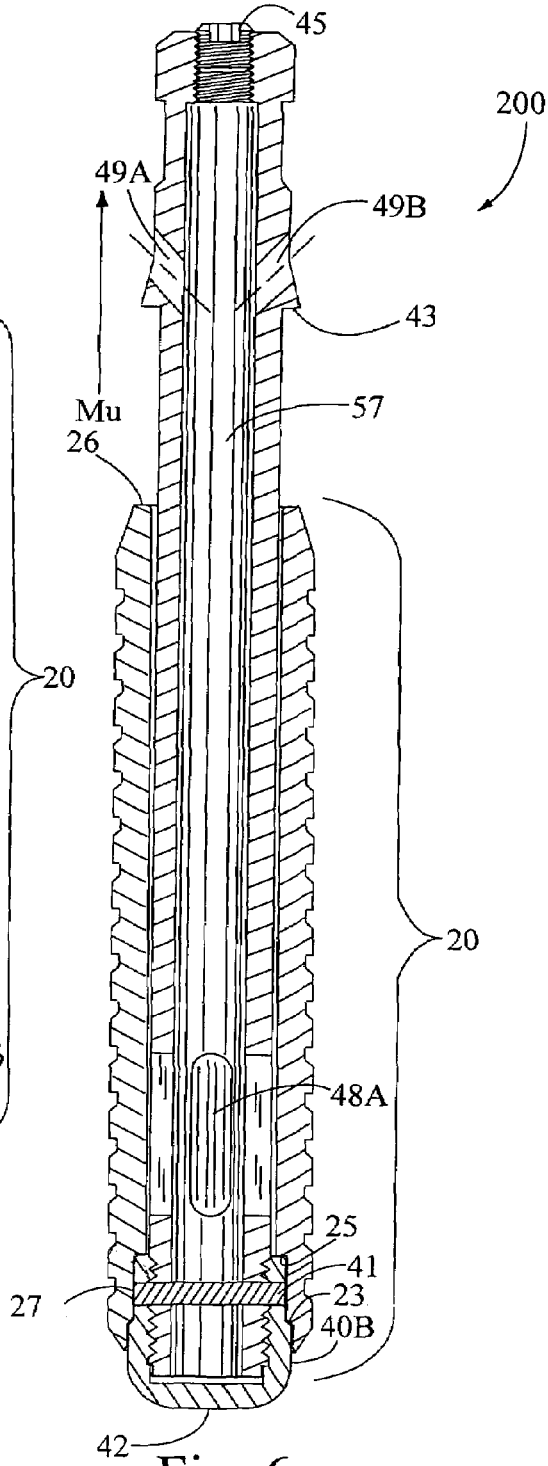
FIG. 6 is a cross-sectional view of a slidable sleeve plunger in a "closed bypass" position.

FIGS. 5, 6 depict a cross-sectional view of a slidable sleeve plunger 200 in the "open bypass" position and in the "closed bypass" position, respectively. Thus, in FIG. 5, plunger 200 is ready to commence the descent phase in direction Mo. In FIG. 6, plunger 200 is ready to commence the ascent phase in direction $M_U$.

Referring first to FIG. 5, lower flange surface 23B and upper flange surface 25B are housed within slidable sleeve 20 near its bottom end. Mandrel 40 houses lower flange surface 23A and lower flange surface 25A.

As shown in FIG. 6, in a closed position, upper flange surface 25B of slidable sleeve 20 contacts upper flange surface 25A of mandrel 40, to form flange seat 25 which is positioned within the sleeve during the ascent phase. Lower flange surface 23B of slidable sleeve 20 contacts lower flange surface 23A of mandrel 40, to form flange seat 23 which is positioned within the sleeve during the ascent phase.

Effectual contact at flange seat 25 and flange seat 23 results in the formation of a seal surface about the entire circumference of each flange. The seals formed by the contact of each respective flange surface help to reduce the likelihood that the bypass will open during plunger ascent. The seals can also help minimize the risk of plunger stall or a premature plunger descent.

During the ascent phase, lower vertical surface 27A of mandrel 40 adjoins lower vertical surface 27B of slidable sleeve 20, whereupon effectual contact of these surfaces forms partial seal 27 between the sleeve and the mandrel. The partial seal 27 operates like an internal suction between the sleeve and the mandrel at the junction of lower vertical surface 27A, 27B to further reduce the risk of mandrel and sleeve separation. The partial seal 27 also reduces the likelihood that fluid F may enter the plunger mandrel orifice 57 or that the sleeve will slide upward to expose entry orifices 48 during plunger ascent to the well top. Thus, the "closed bypass" position will be maintained during an ascent by plunger 200 to the well surface, allowing accumulated fluids to be pushed up and expelled from the well topside. When plunger 200 strikes the top of the well, a top flange surface 26 of slidable sleeve 20 contacts an upper flange surface 43 of mandrel 40 about the flange circumference, whereupon flange seat 25 and flange seat 23 are disengaged. Thus, slidable sleeve 20 slides into an "open bypass" position which causes the plunger to once again fall downhole.

In the "open bypass" position, fluid F may enter mandrel orifice 57 of plunger 200 by means of lower bypass flow entry orifices 48A, 48B and 48C. Fluid F passes through orifice 57 and exits plunger 200 by means of upper bypass flow exit orifices 49A, 49B and also 49C (not shown). Top plug 45 can be removed to provide another means of fluid egress during the plunger descent phase. When a bottom end 42 of mandrel 40 strikes the well bottom, plunger 200 once again cycles into a "closed bypass" position which causes the plunger to move upward. Although the embodiment in FIGS. 5, 6 features a plunger having solid ring sidewall geometry, any suitable external geometry may be chosen.

In FIG. 4A, the embodiment of mandrel 40 is disclosed as two subassemblies. Upper subassembly 40A and lower subassembly 40B are housable within orifice 21 of slidable sleeve 20. Upper subassembly 40A comprises a fishing neck design. Removable top plug 45 may be screwed into mandrel subassembly 40A via upper threads 45S to minimize fluid flow through. Depending on a variety of factors including well parameters and fluid flow during plunger descent to the well bottom, top plug 45 can be left installed on plunger 200. However, top plug 45 may be removed if well flow conditions require a greater fluid and/or gas bypass capability. Because a threaded fixture is employed, it may also be unscrewed or removed easily in the field if desired. For example, an operator may conclude that, based on the particular gas or liquid flow through a well, a larger bypass capacity may be needed. Thus, the operator may remove top plug 45 to control the rate of fluid egress or provide additional area through which fluid may flow. Although removable top plug 45 is shown to be threaded, other fixture means can be chosen.

Upper subassembly 40A is insertable into slidable sleeve 20 wherein subassembly 40A may be retained by assembling lower subassembly 40B. Lower subassembly 40B comprises inner threads 46B, which mate with external threads 46A of upper subassembly 40A. Set pin 41 can hold subassemblies 40A, 40B in a fixed position via acceptance holes 47A (one of two holes are shown) located in upper subassembly 40A and lower subassembly acceptance holes 47B located in lower subassembly 40B. Two flat surfaces 44 (one of two surfaces are shown) function to allow grip points so that lower subassembly 40B may securely joined to upper subassembly 40A.

As stated above in the discussion of FIG. 6, the mandrel's lower flange surface 23A and upper flange surface 25A respectively contact the sleeve's lower flange surface 23B and upper flange surface 25B to form flanges seats 23 and 25, respectively. In addition, the mandrel's lower vertical surface 27A adjoins the sleeve's lower vertical surface 27B to effect partial seal 27 between the sleeve and the mandrel. Flange seats 23, 25 and partial seal 27 can reduce the risk of mandrel and sleeve separation as well as the risk of plunger stall. Because the placement of internal flow entry orifice can also minimize plunger stall, the present apparatus provides orifices 48 which can be located on mandrel 40 distally from the plunger's bottom end 42. Thus, when sleeve 20 slides over mandrel 40, orifices 48 are fully housed within sleeve 20.

Although the disclosed embodiment contemplates a mandrel comprising three exit and entry orifices arranged radially at about 120° intervals from one another, other configurations may be employed; other examples are possible. Not only can the configuration be varied, the number, shape, location, and/or size of orifices can be modified to accommodate a desired application.

FIG. 4B depicts an alternate embodiment of the present apparatus, which is shown here as slidable sleeve plunger 200A. Although plunger embodiment 200A is similar to the plunger embodiment 200 of FIG. 4A, plunger 200A employs an alternative configuration of mandrel 40. In this embodiment, upper subassembly 40C comprises internal threads 46C (not shown) which enables an assembly with lower subassembly 40D by means of lower mandrel external threads 46D. Mandrel 40 comprises mandrel orifice 57 through which fluid may pass. Set pin 41 can hold subassemblies 40C, 40D in a fixed position via upper subassembly holes 47C (one hole shown) located in upper subassembly 40C and lower subassembly acceptance holes 47D (one hole shown) located in lower subassembly 40D. In an "open bypass" position, in this embodiment, fluid could enter three lower bypass flow entry orifices 48, pass through mandrel orifice 57 and exit through three upper bypass flow exit orifices 49. In the perspective view of the embodiment depicted in FIG. 4B, only orifices 48A and 49A are shown. It should be noted that alternate embodiment 200A is presented by example and not of limitation; other embodiments are possible. For example, an embodiment comprising a mandrel having a single assembly or three or more subassemblies could also be feasible. In addition, a mandrel having fewer or additional orifices could be devised. It is also contemplated that the orifices could vary in size, shape, location, and/or angle and still fall within the scope of the disclosed apparatus.

When bottom end 42 strikes the well bottom, various factors such as strike forces, improper alignment, etc. can cause plunger deformation and/or plunger failure. For example, a plunger may not travel downhole in vertical alignment with the well tubing. If such a plunger strikes the well bottom awry, plunger malfunction and/or failure could occur. In some situations, well maintenance could be required to retrieve a failed plunger and/or repair well infrastructure damage caused by a skewed plunger.

As stated above, the mandrel's lower surface 27A and the sleeve's lower surface 27B adjoin to form a partial seal 27, which together with flange seats 23, 25 could serve to fortify bottom 42 to absorb a force of impact. However, it is generally only after a bottom strike occurs that sleeve 20 engaged in a contact position with lower subassembly 40B, 40D, thus fortifying bottom 42 which receives the force which urges the plunger upwards. Thus, in normal operation when plunger 200 strikes bottom, it is generally lower subassemblies 40B, 40D alone which bears a great initial impact. Lower subassemblies 40B, 40D therefore have an increased potential for experiencing stresses such as deformation and/or fatigue. When the plunger slidable sleeve 20 slides into a "closed bypass" position, lower subassembly 40B, 40D also experiences the force of the sleeve closure. The force of the well top strike also can cause stress on a plunger. The disclosed embodiment contemplates a plunger having an optimal surface area at a plunger bottom end which causes strike conditions to be more favorable, thus minimizing stresses such as deformation and/or fatigue. In addition, a smaller sleeve and mandrel gap can serve to minimize radial movement between a sleeve and mandrel. A reduction of radial movement can result in a more optimally flowing plunger, which in turn minimizes plunger stress, enhances plunger integrity and thereby prolongs plunger life. For example, in one embodiment of the present apparatus, the distance between an inner diameter of the sleeve and an outer diameter of the mandrel is small enough to minimize radial movement between the mandrel and slidable sleeve but adequately wide to allow the plunger to slide over the mandrel. The plunger can also have a uniform outer diameter of the mandrel and a uniform inner diameter of the sleeve to lessen radial movement between the top and bottom mandrel ends. In one embodiment of the present apparatus, the plunger is designed to have a large external surface area so that the plunger maintains contact with the casing. Having a larger surface area also helps to minimize radial movement. Thus, the disclosed embodiment has a greater capacity to withstand axial forces exerted on it during plunger strike. As stated above, upper subassembly 40A, 40C and lower subassembly 40B, 40D are housable within orifice 21 of slidable sleeve 20. In these embodiments, the distance over which slidable sleeve 20 travels to contact lower subassembly 40B, 40D may also serve to minimize radial movement, reducing the potential for plunger stress, and thereby prolonging plunger life. For example, with a shorter distance, sleeve 20 could contact lower subassembly 40B, 40D rather quickly, which then causes the plunger to quickly rise. The shorter distance could also signify a shorter mandrel exposure and less possibility of deformation. The longer distance could also signify a longer mandrel exposure which increases the possibility of mandrel deformation.

While a number of exemplifying features and embodiments have been discussed above, those of skill in the art will recognize certain modifications, permutations, additions and subcombinations thereof. No limitation with respect to the specific embodiments disclosed herein is intended or should be inferred. Other alternate embodiments of the present apparatus could be easily employed by those skilled in the art to achieve the bypass function of the present apparatus. It is to be understood that additions, deletions, and changes may be made to the mandrel, slidable sleeve, and various internal and external parts disclosed herein and still fall within the true spirit and scope of the slidable sleeve plunger system.

I claim:

1. A plunger for unloading formation fluids in a high flow hydrocarbon well, said apparatus comprising:

a mandrel comprising a top end, a bottom end, and a mandrel orifice through which fluid passes during plunger descent to the well bottom;

said mandrel further comprising fluid entry means locatable circumferentially about its bottom end to allow fluid to enter said mandrel orifice, and fluid egress means locatable circumferentially about its top end to allow fluid to exit said mandrel orifice;

wherein said mandrel is movable in an axial direction internally within a slidable sleeve to a closed position, whereby said fluid entry means are blocked to fluid entering said mandrel orifice, thereby allowing said plunger to ascend the well and carry loading fluid to the surface;

said mandrel being rotatable within said slidable sleeve: and wherein a flange surface of said slidable sleeve contacts a flange surface of said mandrel to form at least one circumferential flange seat positioned within the sleeve to maintain said closed position during plunger ascent, said plunger being driven up by a pressure of gas present within the well.

2. The apparatus of claim 1, wherein a vertical surface of said slidable sleeve adjoins a vertical surface of said mandrel to effect a partial seal between the sleeve and the mandrel, said partial seal positioned within said sleeve to maintain said closed position during plunger ascent.

3. The apparatus of claim 1, wherein said fluid entry means are located distally from the bottom end of the mandrel, thereby causing said entry means to be fully positioned within said sleeve in said closed position during plunger ascent.

4. The apparatus of claim 1, wherein a well top plunger strike can cause said at least one circumferential flange seat positioned within the sleeve to disengage, thereby allowing the slidable sleeve to slide to an open position, whereby said fluid entry means are unblocked to fluid entering said mandrel orifice, thereby allowing said plunger to descend against flow in the well.

5. The apparatus of claim 1, wherein a well bottom plunger strike can cause said at least one circumferential flange seat positioned within the sleeve to engage, thereby allowing the slidable sleeve to slide to said closed position whereby said fluid entry means are blocked to fluid entering said mandrel orifice, thereby allowing said plunger to ascend in the well.

6. The apparatus of claim 1, wherein the top end of said mandrel further comprises a fishing neck.

7. The apparatus of claim 1, wherein said top end of said mandrel further comprises a removable top plug to provide a means of controlling the rate of fluid egress during plunger descent.

8. The apparatus of claim 7, wherein a removal of said top plug can provide additional means for fluid to exit said mandrel, thereby causing the plunger to fall at an increased rate of speed.

9. The apparatus of claim 1, wherein said fluid entry means further comprises apertures positioned radially at about 120° intervals from one another.

10. The apparatus of claim 1, wherein said fluid egress means further comprises apertures positioned radially at about 120° intervals from one another.

11. The apparatus of claim 1, wherein an outer diameter of said plunger is sufficiently large to enable an external surface of said plunger to maintain contact with a casing of said well, thereby minimizing radial movement of said plunger and allowing the plunger to exert an axial force in a true vertical direction when the plunger strikes the well bottom.

12. The apparatus of claim 1, wherein a distance between an inner diameter of said slidable sleeve and an outer diameter of said mandrel is sufficiently small enough that radial movement of said plunger is minimized, thereby allowing the plunger to exert an axial force in a true vertical direction when the plunger strikes the well bottom.

13. A plunger for lifting formation fluids in a hydrocarbon well, said apparatus comprising:

a hollow body comprising at least one entry orifice positioned near a bottom end, said at least one entry orifice allowing fluid to enter said body and commence a plunger bypass during plunger descent in said well;

at least one exit orifice positioned at a top end of said hollow body to allow fluid egress from said body and complete the plunger bypass;

a slidable sleeve operating to close the at least one entry orifice, thereby causing the plunger to rise and carry accumulated fluid to the well surface;

wherein an attachment means is formed at an internal interface between said sleeve and said hollow body, said attachment means functioning to minimize sleeve separation during plunger ascent in said well.

14. The apparatus of claim 13, wherein the attachment means further comprises a circumferential flange seat positioned within said sleeve, said flange seat formed when a flange surface of said slidable sleeve contacts a flange surface of said mandrel.

15. The apparatus of claim 13, wherein the attachment means further comprises a partial seal positioned within said sleeve, said partial seal formed when a vertical surface of said sleeve adjoins a vertical surface of said mandrel.

16. The apparatus of claim 13, wherein said at least one entry orifice is distal from the bottom end of the hollow body, thereby causing said at least one entry orifice to be fully positioned within said sleeve in a closed position during said plunger ascent.

17. The apparatus of claim 13, wherein an outer diameter of said plunger is sufficiently large to enable an external surface of said plunger to maintain contact with a casing of said well, thereby minimizing radial movement of said plunger occurring during plunger drop and when impact occurs.

18. The apparatus of claim 13, wherein a distance between an inner diameter of said slidable sleeve and an outer diameter of said mandrel is sufficiently small that radial movement of said plunger is minimized during plunger drop and when impact occurs.

19. A plunger for lifting fluids in a hydrocarbon well, said apparatus comprising:

a slidable sleeve to slide axially along a hollow body, said hollow body comprising a first and a second end;

said first end comprising at least one entry through which fluid may enter said hollow body;

said second end comprising at least one egress through which fluid may exit said hollow body;

wherein said slidable sleeve operates to close said at least one entry, thereby preventing fluid from entering and bypassing said hollow body, whereby said plunger rises due to a pressure of accumulated gas, carrying accumulated fluid upward;

wherein said at least one entry is distal from said first end, thereby causing said at least one entry to be fully positioned within said sleeve during a plunger closure;

wherein a flange of said slidable sleeve contacts a flange of said hollow body to form a circumferential flange seated within the sleeve, said circumferential flange sustaining said plunger closure during plunger ascent; and wherein a vertical surface of said slidable sleeve adjoins a vertical surface of said mandrel to form a partial seal between the sleeve and the mandrel, said partial seal positioned within said sleeve to sustain the plunger closure.

20. A plunger for lifting fluids in a hydrocarbon well, said apparatus comprising:

a hollow body comprising at least one entry through which fluid may enter said hollow body and at least one egress through which fluid may exit said hollow body;

a slidable sleeve to slide axially along said hollow body, wherein said slidable sleeve operates to open said at least one entry, thereby allowing fluid to enter and commence bypass of said hollow body, whereby said plunger falls against flow to the well bottom due to gravity;

said hollow body being rotatable within said slidable sleeve;

wherein a distance between an inner diameter of said slidable sleeve and an outer diameter of said hollow body is sufficiently small to minimize radial movement of said plunger during plunger descent and when impact occurs; and wherein an outer diameter of said plunger is sufficiently large to enable an external surface of said plunger to maintain contact with a casing of said well, thereby minimizing said radial movement of said plunger occurring during plunger descent and when impact occurs at the well bottom.

* * * * *